US006436009B1

(12) United States Patent
Marucci

(10) Patent No.: US 6,436,009 B1
(45) Date of Patent: Aug. 20, 2002

(54) TREADMILL FALL PREVENTION SYSTEM

(76) Inventor: Laurence Marucci, 200-69 Rollins Dr., Greenville, NC (US) 27834

( * ) Notice: Subject to any disclaimer, the term of this patent is extended or adjusted under 35 U.S.C. 154(b) by 0 days.

(21) Appl. No.: 09/840,687

(22) Filed: Apr. 23, 2001

(51) Int. Cl.[7] ..... A63B 22/02
(52) U.S. Cl. ..... 482/54; 482/51
(58) Field of Search ..... 482/51, 54

(56) References Cited

U.S. PATENT DOCUMENTS 4,898,378 A * 2/1990 Edwards et al. ..... 482/54
5,081,991 A * 1/1992 Chance ..... 482/54
5,100,127 A * 3/1992 Melnick et al. ..... 482/54
5,667,461 A * 9/1997 Hall ..... 482/54

* cited by examiner

*Primary Examiner*—Glenn E. Richman
(74) *Attorney, Agent, or Firm*—Mills Law Firm PLLC

(57) ABSTRACT

A vertical fall prevention system for use in conjunction with a treadmill that supports the user in the event of physical difficulties without interfering with the intended or desired activities of the user. A treadmill restrain system in accordance with the invention includes a user restrain belt or harness that is connected to an overhead support. The belt or harness include releasable connecting links with support straps or cables attached to the overhead support. The connecting links are disposed rearwardly of the user, preferably not interfering with user arm movement thereby allowing the user to utilize the full capabilities of the treadmill during testing or exercising. Sufficient freedom of movement is provided the user for normal excursions on the treadmill surface, while fully supporting the weight of the patient with limited vertical drop until balance can be restored, the treadmill stopped, and necessary third party assistance rendered.

6 Claims, 4 Drawing Sheets

TREADMILL FALL PREVENTION SYSTEM

FIELD OF THE INVENTION

The present invention relates to treadmills, and, in particular, a fall prevention system for preventing injury of a person undergoing treadmill exercise, such as a cardiovascular stress test.

BACKGROUND OF THE INVENTION

The electrocardiography (ECG) treadmill stress test is widely used in evaluating chest pain. Therein, electrodes are taped to the chest of the patient and connected to an adjacent ECG machine, generally under the control of a medical technologist. The ECG machine makes a continuous recording of the electrical activity of the patient's heart while the patient walks at a pace selected by the test protocol. Thereafter, the speed of the treadmill is increased to the maximum the patient can tolerate. If the trace remains normal during the maximum exertion, it is unlikely that the patient has a serious heart disorder. Abnormal traces may give rise to further testing and treatment.

The ECG machine, while proximate to the treadmill, is generally surrounded by cables and other equipment, precluding physical assistance by the technologist if difficulties develop during the test. Moreover, the patient population undergoing such testing varies considerably in height and weight, oftentimes beyond the ability of the technologist to manage under adverse conditions. Inasmuch as the treadmill stress test paces patients with medical conditions to utmost exertion, from time to time, the patients may collapse, stumble or fall during the test before the technologist can stop the treadmill and physically intervene. Injury to the patient, and injury to the assisting technologist may ensue. Such potential consequences are attendant to the test as currently administered. Moreover, similar problems exist with regard to persons using the treadmill for strenuous exercise and training.

In view of the foregoing, it would be desirable to provide a system for the prevention of injuries to patients undergoing treadmill stress testing that is compatible with existing ECG machines and associated treadmills.

SUMMARY OF THE INVENTION

The foregoing objects are accomplished by providing a vertical fall prevention system in conjunction with a treadmill that supports the user in the event of physical difficulties without interfering with the intended or desired activities of the user. A treadmill restrain system in accordance with the invention includes a user restrain belt or harness that is connected to an overhead support. The belt or harness include releasable connecting links with support straps or cables attached to the overhead support. The connecting links are disposed rearwardly of the user, preferably not interfering with user arm movement thereby allowing the user to utilize the full capabilities of the treadmill during testing or exercising. Sufficient freedom of movement is provided the user for normal excursions on the treadmill surface, while fully supporting the weight of the patient with limited vertical drop until balance can be restored, the treadmill stopped, and necessary third party assistance rendered. The fall prevention system may be connected to the ceiling structure of the test facility. Preferably, however, the fall prevention system is carried by a support stand disposed about the treadmill, and suitably attached or securely supported on the test facility floor. The fall prevention system may be provided with a weight sensitive interface for automatically stopping the treadmill belt, when user distress is sensed, as well as emitting an audible or visual signal upon such occurrences.

Accordingly, it is an object of the present invention to provide a fall prevention system for treadmill users that limits injury resulting from physical distress during operation.

Another object of the invention is to provide a patient fall prevention system for patients undergoing electrocardiographic treadmill testing to prevent patient injury due to patient collapse or physical difficulties during the test.

A further object of the present invention is to provide a fall prevention harness for ECG treadmill stress test patients that limits falling movement of the patient if physical difficulties arise during the course of the test.

DESCRIPTION OF THE DRAWINGS

The above and other objects and advantages of the present invention will become apparent upon reading the following detailed description taken in conjunction with the accompanying drawings in which.

DETAILED DESCRIPTION OF THE PREFERRED EMBODIMENTS

Figure 1:
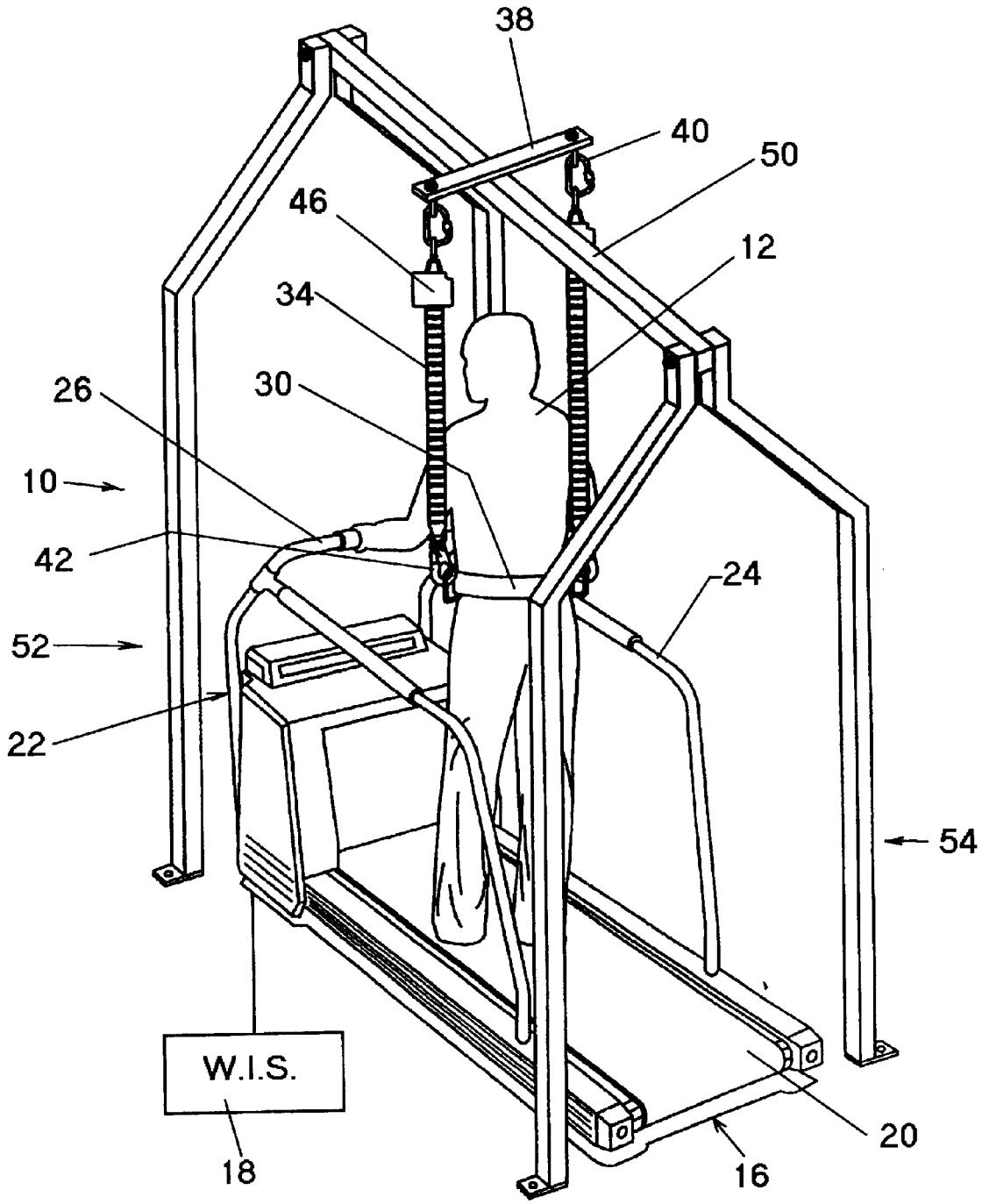
FIG. 1 is a perspective view of an ECG treadmill stress unit provided with a patient restrain system, including control schematics.

Referring to the drawings for the purpose of describing the preferred embodiments and not for limiting same, FIG. 1 illustrates a treadmill fall prevention system 10 for use in conjunction with an electrocardiographic treadmill stress test for a patient 12 being tested for heart conditions on a treadmill 16 as controlled and recorded by a conventional electrocardiographic machine 16 operated by an attending medical technologist. The patient 12 is conventionally connected to the machine with electrodes, not shown, whereby tracings are made of selected heart electrical functions as the patient is tested under protocols to maximum exertion dictated by treadmill tread speed and inclination. The fall prevention system 10 limits downward movement of the patient if disabling difficulties, such as falling, stumbling, fainting and the like, occur during the course of the stress test. The system 10 may also be provided with a warning and interruption system 18 for stopping the treadmill and providing a visual and audible warning when patient disabling conditions are sensed, as described in greater detail below.

The treadmill 16 may be any of various commercially available designs approved for ECG stress testing. The treadmill 16 includes a continuous tread 20 on which the patient runs or walks dependent on tread speed developed by the tread drive motor, not shown, the operation and speed of which is controlled by the technologist at the machine 16. A handlebar frame 22 including side rails 24 and front rails 26 may be gripped by the patient for support during the test.

The fall prevention system 10 comprises an adjustable inertial restraint harness in the form of a safety belt 30, adjustable support straps 34 attached at lower ends to the belt 30 and at upper ends to a support frame 36 at a transverse connector bar 38. The safety belt 30 is disposed about the waist of the patient and includes a pair of connecting links 32 at the rear thereof, behind and inwardly of normal arm movement of the patient during the test so as not to affect desired patient activities in reaching the test objectives. As an alternative to the waist belt, the harness system may include a suitable user harness worn on the upper body. The lower connection between the safety belt 30 and the straps 34 includes D-rings 40 carried at the rear of the belt 30 that are releasably engaged by snap hooks 42 on the lower end of the straps 34. The hooks 42 include spring biased safety arms for preventing inadvertent disengagement during use.

The support straps 34 include inertial retractors 46 that allow length extension under unloaded conditions for accommodating varying user heights and normal movement. The retractors 46 lock and fix the strap length upon abnormal downward loading. The retractors 46 are releasably coupled to the eyelets 47 on the connector bar 38 by lockable safety rings 48.

The support frame 36 includes a longitudinal support arm 50 attached at a frontal leg assembly 52 and rearward leg assembly 54. The leg assemblies straddle the treadmill and elevate the support arm 50 above the patient sufficiently to allow disposition of the fall prevention system without limiting patient movement. A height of at least about 8 feet above the tread is preferred.

Figure 2:
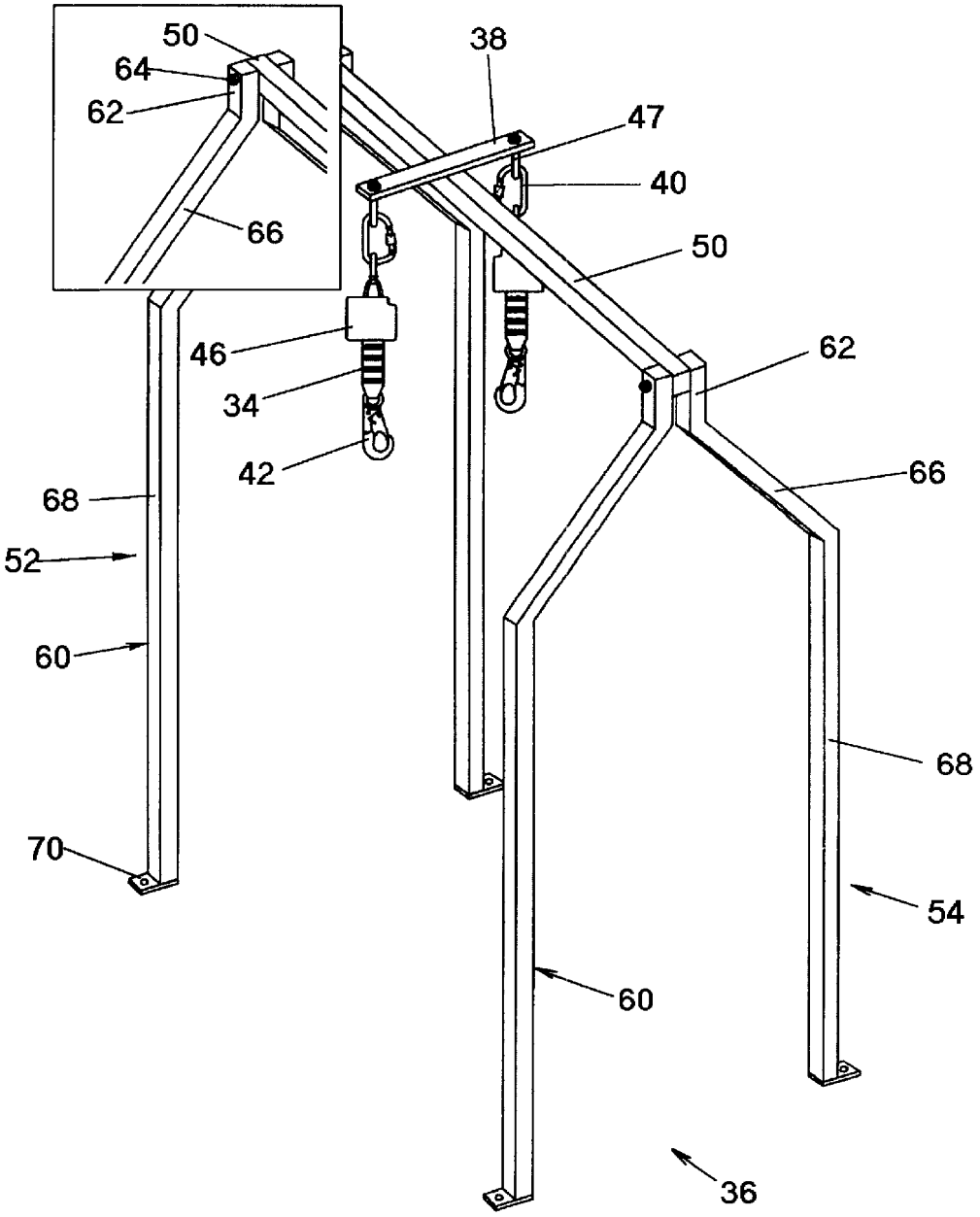
FIG. 2 is a perspective view of the fall prevention support stand including an enlarged inset fragmentary view of the upper support connection.

As shown in FIG. 2, the leg assemblies comprise a pair of Z-shaped legs 60 in symmetrically disposed relationship to the support arm 50. The legs 60 include an upper arm 62 connected to the end of the support arm 50 and opposed arm of the other leg by fasteners 64, a middle arm 66 diverging outwardly and downwardly from upper arm 62, and a vertical lower arm 68 having mounting feet 69 for mechanical attachment or gravitational support on the floor of the test facility. It will be apparent that the support stands may be adapted to the facility and the treadmill specifications, subject to the above considerations that a stable overhead support location be provided for the belt and straps. Further, the straps may be connected at a single location as an alternative to the dual suspension points described above. The base of the stand may be free standing on pads of sufficient size to provide stability while being transportable about the facility to accommodate repositioning of the treadmill. Where a dedicated site is provided, the base may be mechanically fastened to the floor. Moreover, if the treadmill permits, the support system may be attached to and carried by the treadmill unit.

Figure 3:
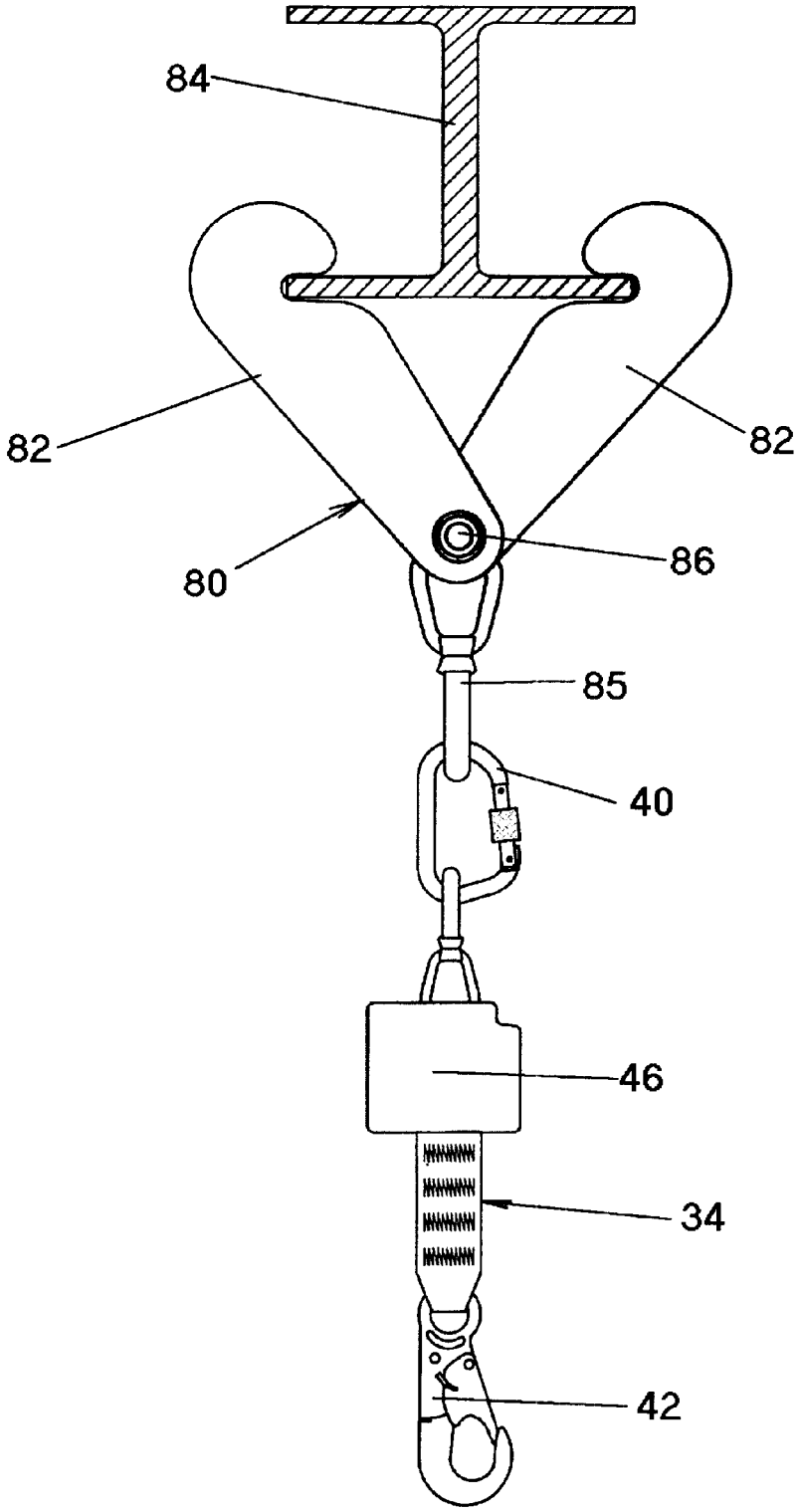
FIG. 3 is a side elevational view of an embodiment of the fall prevention support system for attachment with a ceiling support.

Referring to FIG. 3, the fall prevention straps may also be connected to vertical attachment structure such as the ceiling framing if a free standing frame is not preferred. Therein a pivot clamp hook assembly 80 includes slotted arms 82 that slidably engage the lower side flanges of ceiling beam 84. The straps are connected to an eyelet 85 at a lower pivotal connection 86 on the hook assembly 80 for integration with the fall prevention described above.

Figure 4:
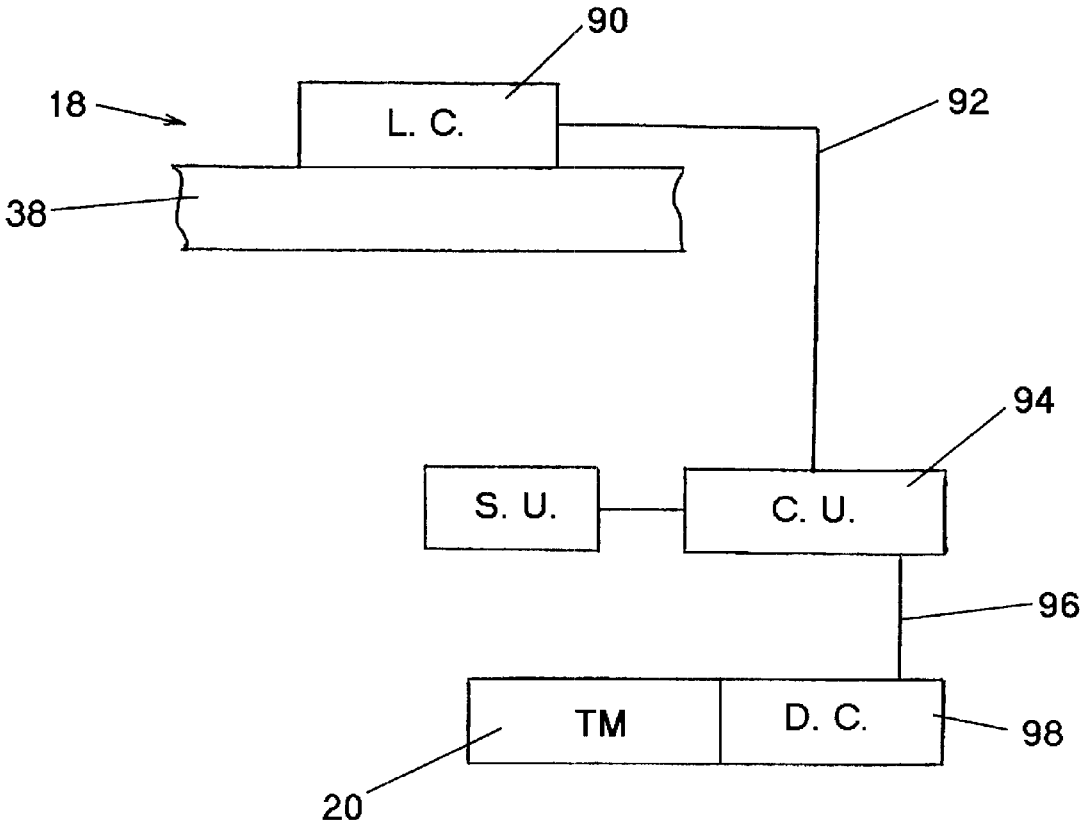
FIG. 4 is a schematic diagram of the control system for the fall prevention system.

Referring to FIG. 4, the treadmill warning and interruption system 18 includes a load cell 90 carried on the connector bar 38 that generates an output in accordance with loading variations and is connected by cable 92 to control unit 94. The control unit 94 is interfaced with the treadmill 20 at the drive controller 96 by cable 98. A change in loading at the load cell 90 above a threshold level indicative of normal loading generates a signal to the control unit 94 thereby stopping the treadmill drive. Concurrently the control unit emits an audible and visual warning at signal unit 99.

The fall prevention system may be adapted to interface with existing equipment, both treadmill and cardiographic, while retaining the passive fall prevention capabilities above described.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. In combination with a treadmill and an electrocardiograph unit operatively coupled with a user, a vertical fall prevention system that supports the user in the event of physical difficulties without interfering with the intended or desired activities of the user, said restrain system comprising: a belt worn around the waist of the user; vertical support means located above the treadmill; a pair of support straps connected at upper ends to said support means and releasably connected at lower ends to said belt rearwardly of the arms of the user so as not to interfere with user arm movement; and inertial retractors operatively associated with said support straps providing an operative length not supporting the weight of the user thereby allowing the user to utilize the full capabilities of the treadmill during testing or exercising whereby freedom of movement is provided during normal excursions on the treadmill surface, said inertial retractors fixing the length of said support straps and filly supporting the weight of the patient after limited vertical drop until user position can be restored, the treadmill stopped, and/or necessary third party assistance rendered.

2. The fall prevention system as recited in claim 1 wherein said support means is structurally attached to a ceiling member above the treadmill.

3. The fall prevention system as recited in claim 1 including a support stand carried at the sides of the treadmill having a vertical support member positioned above the treadmill to which said strap means are attached.

4. The fall prevention system as recited in claim 1 wherein the upper ends of said strap members are connected to said support means at transversely spaced locations.

5. The fall prevention system as recited in claim 1 including means for stopping said treadmill if said strap means are loaded above a predetermined amount.

6. The fall prevention system as recited in claim 5 including means for providing a discernable warning if said strap means are loaded above a predetermined amount.

* * * * *